US005624628A

United States Patent [19]

Hansch et al.

[11] Patent Number: 5,624,628

[45] Date of Patent: Apr. 29, 1997

[54] METHOD OF INTRODUCING A CASTING COMPOUND INTO A HOLLOW SPACE

[75] Inventors: Werner Hansch, Utting; Christoph Nieberle, Fürstenfeldbruck; Oswald Nützel, Munich, all of Germany

[73] Assignee: Dyckerhoff & Widmann Aktiengesellschaft, Munich, Germany

[21] Appl. No.: 531,130

[22] Filed: Sep. 20, 1995

[30] Foreign Application Priority Data

Sep. 22, 1994 [DE] Germany ..... 44 33 847.3

[51] Int. Cl.[6] ..... B29C 65/48

[52] U.S. Cl. ..... 264/513; 264/112; 264/121; 264/128; 264/229; 425/111; 425/123

[58] Field of Search ..... 264/513, 112, 264/121, 128, 229; 425/111, 123

[56] References Cited

U.S. PATENT DOCUMENTS 4,836,967 6/1989 Frantl et al. ..... 264/69
5,094,798 3/1992 Hewitt ..... 264/511
5,106,554 4/1992 Drews ..... 264/112
5,230,850 7/1993 Lewis ..... 264/112

FOREIGN PATENT DOCUMENTS 1609722 6/1971 Germany .

*Primary Examiner*—Mary Lynn Theisen
*Attorney, Agent, or Firm*—Friedrich Kueffner

[57] ABSTRACT

A method of introducing a casting compound composed of aggregates and a matrix with a hardening binder into a hollow space within a tubular sheathing of a tension member composed of one or more individual elements, particularly in the anchoring range of the tension member relative to a structural component. In accordance with the method, the aggregates are introduced first and the matrix is then introduced in the liquid state into the grain structure formed by the aggregates. A finely granular material is used as the aggregate. The finely granular material is introduced with the aid of compressed air through at least one tubular lance which is inserted in longitudinal direction of the tension member through the anchoring range.

17 Claims, 5 Drawing Sheets

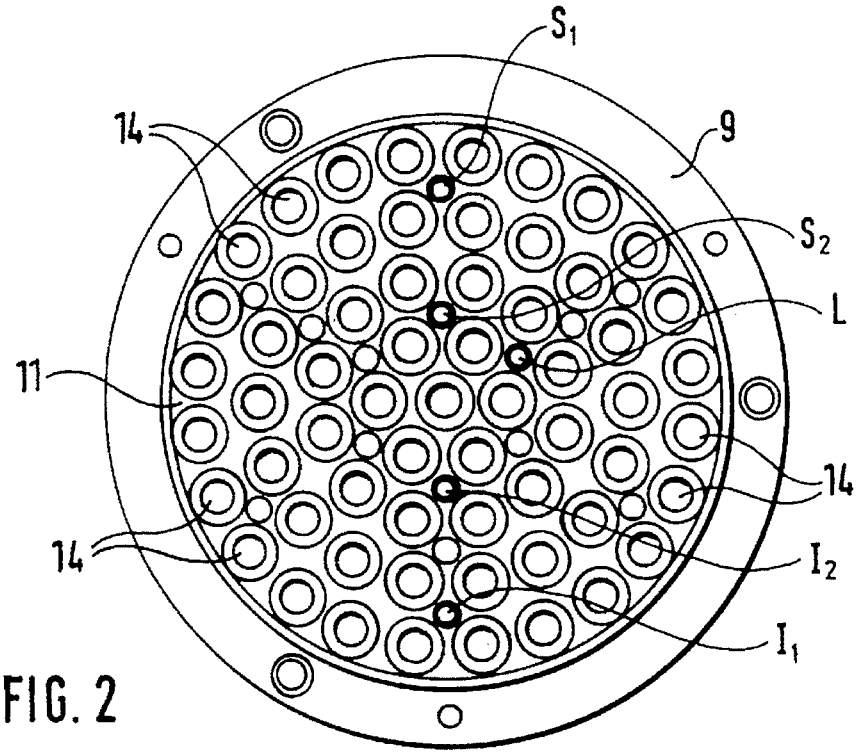
FIG. 2
FIG. 3
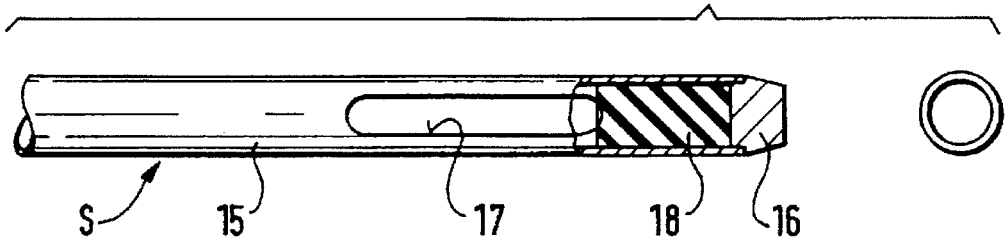
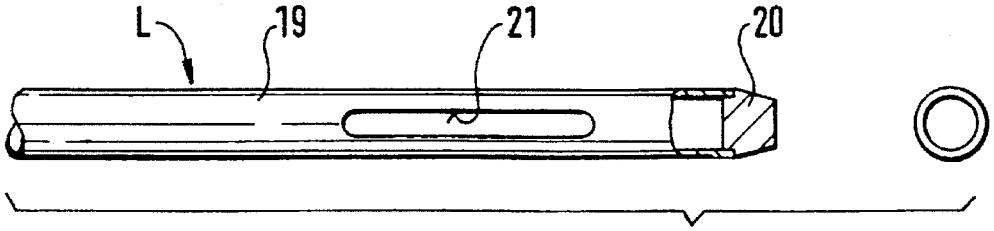
FIG. 4

METHOD OF INTRODUCING A CASTING COMPOUND INTO A HOLLOW SPACE

BACKGROUND OF THE INVENTION

1. Field of the Invention

The present invention relates to a method of introducing a casting compound composed of aggregates and a matrix with a hardening binder into a hollow space within a tubular sheathing of a tension member composed of one or more individual elements, particularly in the anchoring range of the tension member relative to a structural component. In accordance with the method, the aggregates are introduced first and the matrix is then introduced in the liquid state into the grain structure formed by the aggregates.

2. Description of the Related Art

In corrosion-protected tension members, for example, prestessing members for prestressed concrete or stay cables for cable-stayed bridges, frequently several individual elements, such as, steel rods, steel wires or steel wire strands, are combined into a bundle and are arranged within a tubular sheathing. In the area of the free length of the tension member, this tubular sheathing usually is composed of a sheathing tube of synthetic material, for example, polyethylene. In the anchoring range where the individual elements are spread apart for anchoring, the tubular sheathing is composed of an outwardly flaring steel pipe. In order to protect the individual elements within the tubular sheathing against corrosion, on the one hand, and to achieve a bonding action between the individual elements and the tubular sheathing where the tubular sheathing is of steel, for example, in the anchoring range, on the other hand, the hollow space remaining between the individual elements and the tubular sheathing is filled out with a casting compound of aggregates and a matrix with a hardening binder. This casting compound is usually a cement mortar which is injected into the hollow space by means of appropriate injecting lines.

In a stay cable for a cable-stayed bridge which is loaded by a permanent load, i.e., dead weight, as well as by changing loads, i.e., traffic loads, it is also known to separate the introduction of the traffic loads into the structure from the introduction of the permanent loads. In that case, the permanent loads are introduced into the structure through the individual anchoring points of the individual elements. For introducing the traffic loads which occur only after tensioning and injection of the casting compound, a bonding action is produced in the anchoring range between the individual elements and a steel pipe which forms the tubular sheathing in this range, so that the traffic loads are introduced into the steel pipe by the bonding action of the individual elements and the traffic loads are introduced directly from the steel pipe to the concrete of the structure, as disclosed in German patent 21 14 863. This means that the actual anchoring points of the individual elements remain essentially free of the vibratory stresses due to traffic loads.

For anchoring the tension members within the hollow space of a support body, for example, an anchoring sleeve, particularly for anchoring wire bundles which are spread apart in the manner of a broom for anchoring, a casting compound of grains and hardening binder is known from German patent 16 09 722. Within this casting compound a tightly packed heap of metal grains forms support vaults between the inner surface of the support body and the tension members, while the binder is introduced in the liquid state into the hollow space only after the metal grains have been filled into the hollow space. Initially, the hollow space is filled from the top with metal grains up to a certain level and the filling is treated in such a way that the grains are tightly packed. Subsequently, the binder is pressed in from below through an inlet opening, so that the binder fills out all hollow spaces between the metal grains and the wires embedded in the metal grains. The binders may be reaction-hardening synthetic materials or also an inorganic binder, namely, cement suspension. Because of the high costs for the metal grains, such a casting compound is only suitable, if at all, for anchoring systems which are prefabricated in a factory.

SUMMARY OF THE INVENTION

Therefore, it is the primary object of the present invention to provide a simple but also reliable possibility in a mounted and already tensioned tension member for producing at least in the anchoring ranges of the tension member next to the individual anchoring points of the individual elements a bonding action between the individual elements and a tubular sheathing which surrounds the individual elements and for simultaneously ensuring the corrosion protection.

In accordance with the present invention, a finely granular material is used as the aggregate. The finely granular material is introduced with the aid of compressed air as conveying means through at least one tubular lance which is inserted in longitudinal direction of the tension member through the anchoring range.

Accordingly, the grain structure of the casting compound of the present invention is composed of a finely granular material, preferably sand having an essentially uniform grain size, which can be blown in with the aid of compressed air through lances which penetrate the anchoring means of the tension member, i.e., the anchoring disc. It has been found that in spite of the tight packing of the grains in a grain structure formed in this manner, there remain a sufficient quantity of hollow spaces for making it possible to press in a highly liquid binder from the low point of the sand filling until it emerges at the upper surface of the sand filling; ventilation takes place also through the grain structure.

As a result of the separate introduction of aggregate and matrix as compared to a pasty mortar mixture, it is possible to transport the aggregate and the matrix separately to the location of use; premixing is unnecessary and simple and proven conveying units can be used. Since only the hollow spaces in the grain structure have to be filled out, up to 50% of the binder can be saved.

In order to prevent that the sand being blown in produces too much dust which could cover the metal components of the individual elements and the tubular sheathing and could impair a bonding action, an insert of elastic material, such as, rubber, is inserted into the lance which is closed at the outlet end with the exception of lateral outlet openings. As a result, the sand grains which impinge due to the air flow can be cushioned softly. In addition, another lance which is also closed with the exception of lateral outlet openings is inserted at a certain distance from the sand lance and prior to the sand lance, wherein only compressed air is introduced into the additional lance in order to remove any dust deposits.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

FIG. 2 is a top view of the anchoring point from the air side;

FIG. 3 shows a longitudinal sectional view and a cross sectional view of the front end of a sand lance;

FIG. 4 is a longitudinal sectional view and a cross sectional view of an air lance;

DESCRIPTION OF THE PREFERRED EMBODIMENTS

Figure 1:
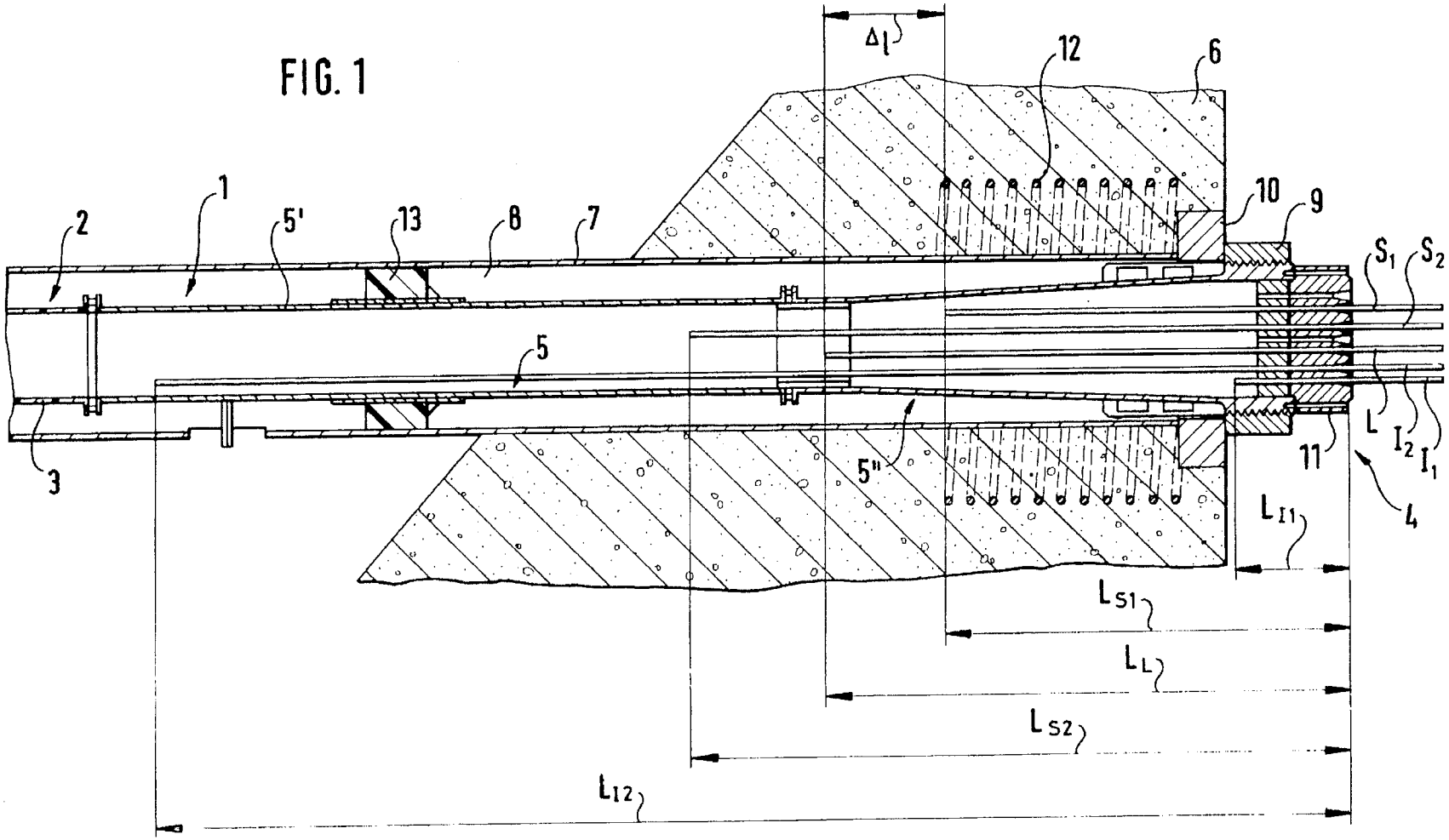
FIG. 1 is a longitudinal sectional view of the anchoring range of a stay cable for a cable-stayed bridge.

FIG. 1 of the drawing is a schematic longitudinal sectional view of the anchoring range of a tension member 1, for example, a stay cable for a cable-stayed bridge. For clarity's sake, only those components are illustrated which are significant with respect to the present invention and the components which form the supporting portion of the tension member 1, i.e., the bundle of individual elements, such as, steel rods, steel wires or steel wire strands, are not shown. This bundle, not shown, is arranged in a tubular sheathing 2 which in the free area of the tension member 1 is composed of a sheathing tube 3 of synthetic material, for example, polyethylene. In the adjacent area forming the actual anchoring point 4, the sheathing 2 is composed of a steel pipe 5. The steel pipe 5 has a portion 5' connected to the sheathing tube 3 and an outwardly flaring portion 5".

The tension member 1 extends within a structural component 6 in which it is anchored, for example, a tower of a cable-stayed bridge, in a duct 8 formed by a formwork tube 7, so that the tension member 1 is longitudinally movable and, thus, replaceable in the structural component. The flaring portion 5" of the steel pipe 5 is connected to a bearing ring 9 which rests against an abutment plate 10. An anchoring disc 11 rests against the bearing ring 9, wherein the individual elements, not shown, of the member 1 are anchored in the known manner in the anchoring disc 11. For absorbing any disc-related tensile forces, the flaring portion 5" is surrounded by a reinforcing spiral 12 in the anchoring range. Within the formwork tube 7, the tension member 1 is elastically supported by a bearing ring 13 of an elastomer material.

In the method according to the present invention, the aggregates, i.e., the sand, as well as the binder of the matrix, i.e., a synthetic resin, for the casting compound, are separately introduced into the hollow space behind the anchoring disc by means of lances extending through bores in the anchoring disc; the materials are each introduced from the low point of the respective hollow space.

Figure 5:
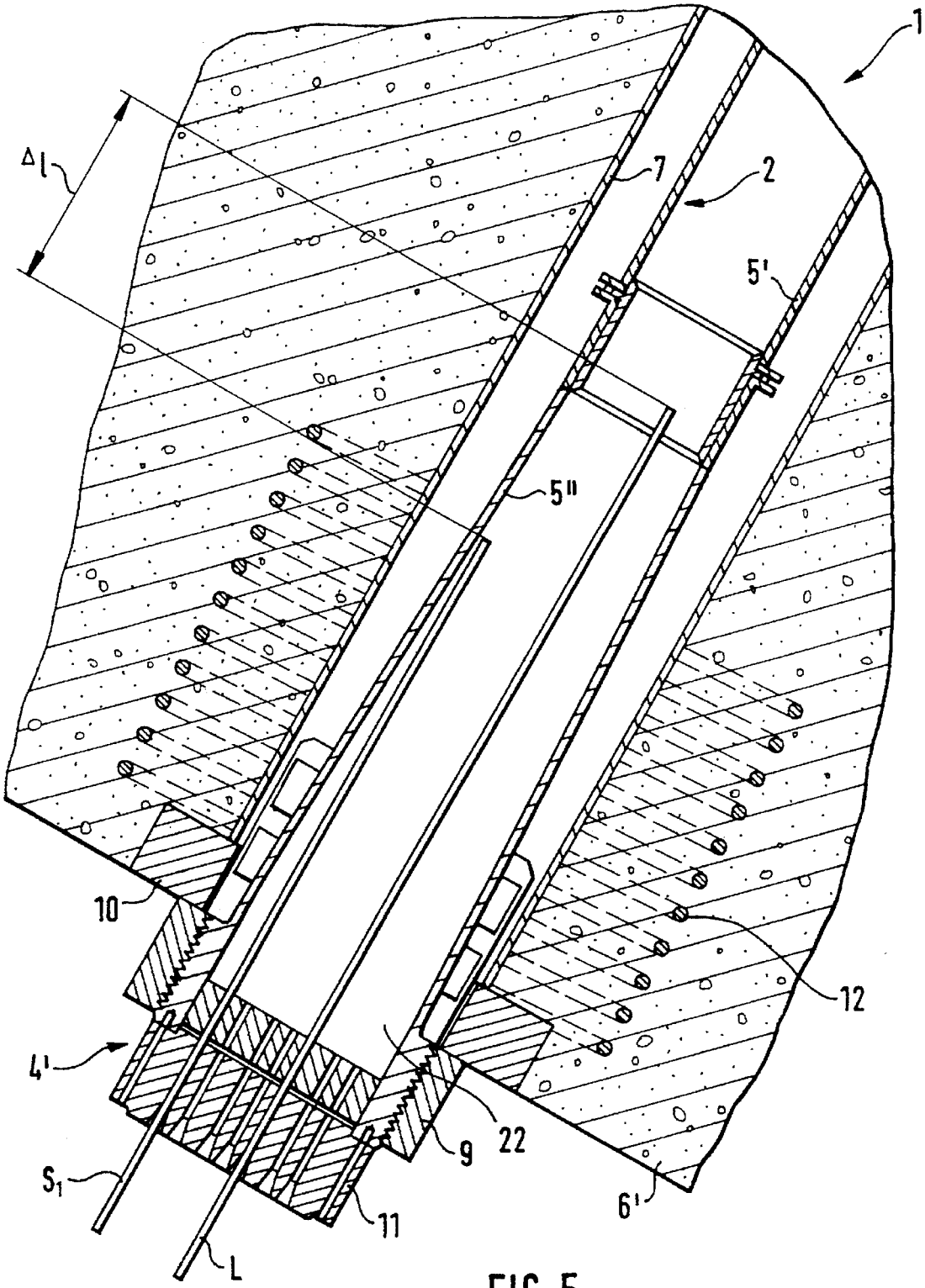
FIG. 5 is a sectional view showing the arrangement of the lances during the introduction of the aggregates in the case of an outwardly directed tension member.
Figure 6:
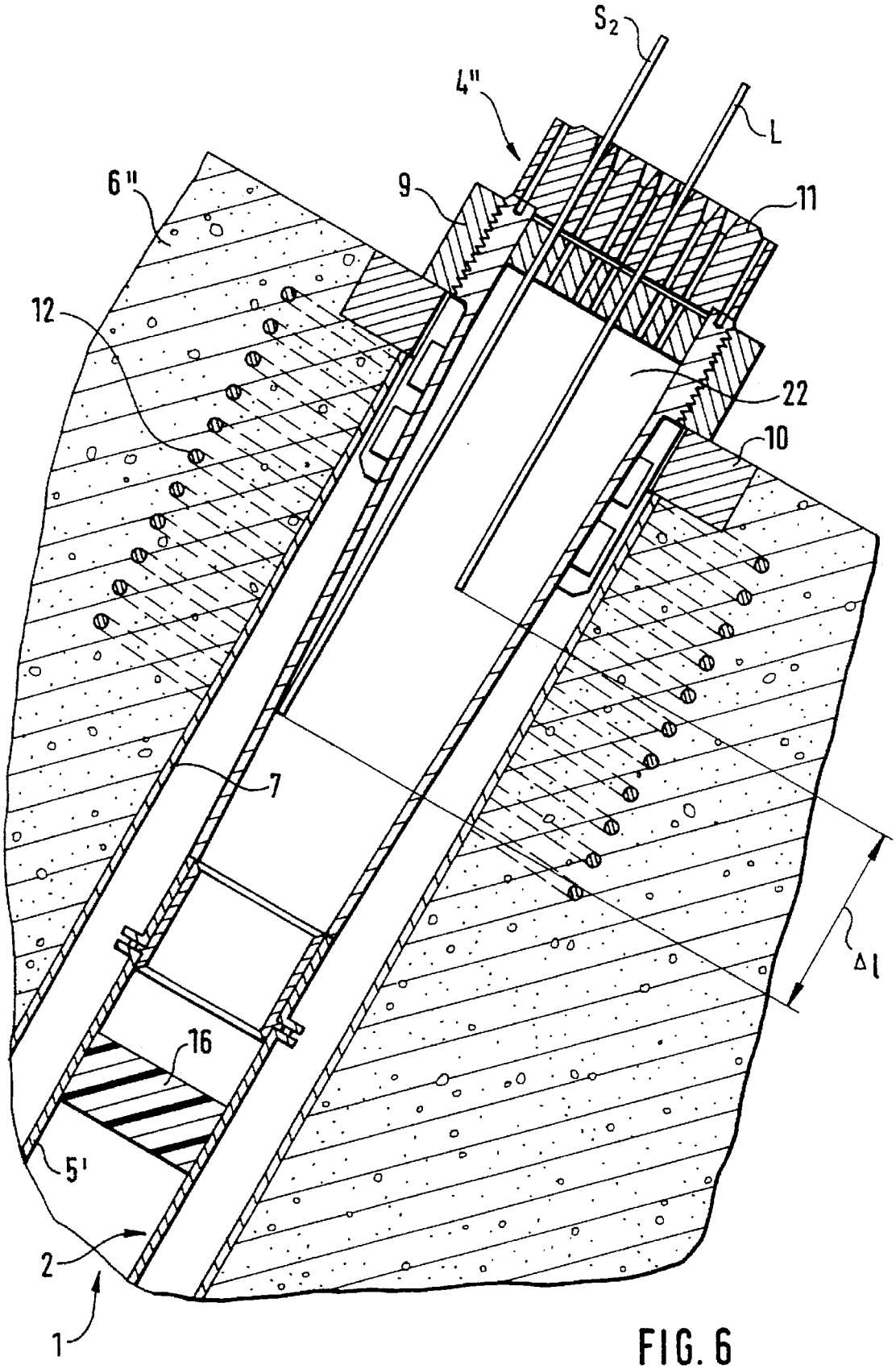
FIG. 6 is a sectional view showing the arrangement of the lances during the introduction of the aggregates in the case of a downwardly directed tension member.

Accordingly, the method according to the present invention is carried out by using lances which extend through the anchoring disc 11. The lances serve to introduce sand for forming a grain structure in the area to be filled with compressed filling material and for introducing or removing the binder required for gluing the grain structure together and, finally, for blowing in air for rinsing. Since liquids must be injected so as to rise, the schematic view of FIG. 1 shows a shorter sand lance $S_1$ having the length $L_{s1}$ for use in a lower anchoring unit at the girder of a cable-stayed bridge, as shown in FIG. 5, and a longer sand lance $S_2$ having the length $L_{s2}$ in an upper anchoring unit at the tower of the bridge, as shown in FIG. 6.

An air lance L having the length $L_L$ ends at a distance $\Delta 1$ from the sand lance $S_1$ and also at an appropriate distance from the sand lance $S_2$. When the binder is injected upwardly in a lower anchoring unit, a short injecting lance $I_1$ having the length $L_{I1}$, and a longer injecting lance $I_2$ having the length $L_{I2}$ is used in the case of an upper anchoring unit.

FIG. 2 shows in a top view of the anchor disc 11 how these lances can be arranged in the cross section of the bundle in the anchoring disc 11 between the bores 14 for anchoring the individual elements, not shown, of the tension member 1. The anchoring disc 11 has additional bores between the bores 14 for introducing the individual elements in radial rows.

FIG. 3 of the drawing shows the outlet end of a sand lance S. The sand lance S is composed of a tube 15 of steel or synthetic material which is closed at the end by a closure 16. At a slight distance in front of the closure 16, at least one oblong opening 17, or preferably two oblong openings 17, are provided on opposite sides, so that a flow of sand and air can be discharged toward the side. The flow of sand and air is conveyed to the respective lances through hoses which are connected to a compressed air generator and a metering unit for sand.

In order to prevent an excessive development of dust from sand grains which are broken up when they impinge against the inner side of the closure 16, a cushion 18 of an elastic material, for example, rubber or synthetic material, is arranged in front of the closure 16.

The air lance L is shown in FIG. 4. The air lance L is also composed of a tube 19 of steel or synthetic material with a closure 20 and at least one oblong opening 21, preferably two oblong openings 21.

Figure 7:
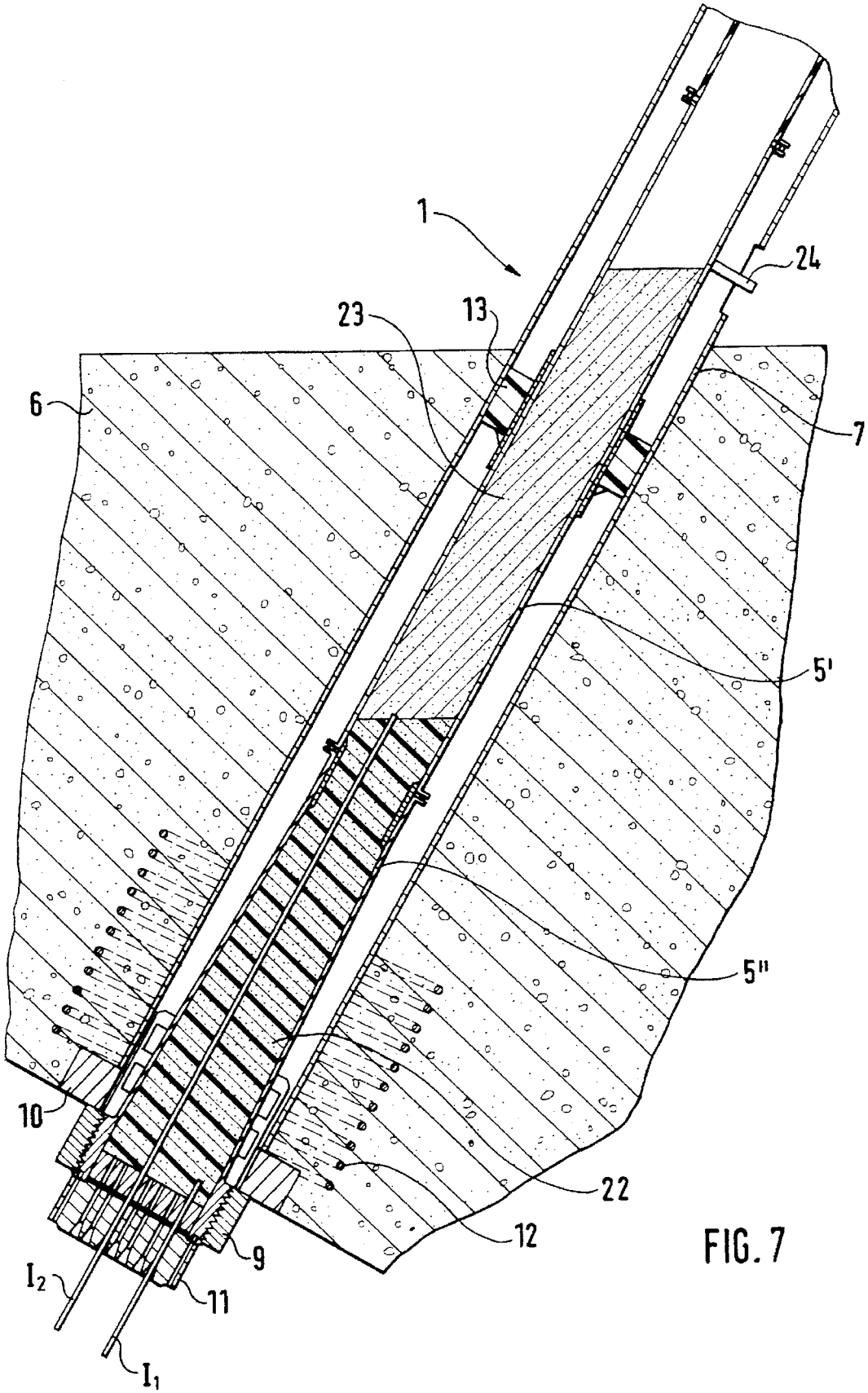
FIG. 7 is a longitudinal sectional view of an anchoring range of a stay cable filled in accordance with the present invention.

The method according to the present invention is carried out in two steps, wherein the first step comprises blowing in sand and compacting the sand in the hollow space remaining within the anchoring tube 5 after the individual elements have been inserted and tensioned, and the second step comprises pressing the binder into the space already filled with sand. The first step is illustrated in FIGS. 5 and 6, wherein FIG. 5 is a lower anchoring unit 4', for example, in the girder 6' of a cable-stayed bridge and FIG. 6 is an upper anchoring unit 4", for example, in the tower 6" of a cable-stayed bridge. The second step is shown in FIG. 7 only in a lower anchoring unit 4'. In the example of FIG. 5, the sand is blown in by means of compressed air beginning approximately 30 cm behind the anchoring disc 11 by using the lance $S_1$ which is located in the apex of the hollow space 22. Since, as shown in FIG. 3, the lance $S_1$ is closed at the outlet side and is provided with lateral openings 17, a good transverse distribution of the sand in the hollow space is achieved.

Even though the cushion 18 of elastic material essentially prevents excessive grinding of the sand when the sand impinges on the closure 16 at the end of the lance, fine dust is still produced by the friction of the sand within the supply lines and within the lance itself. This fine dust can deposit on the individual elements and on the inner wall of the anchoring tube 5 and can reduce or even eliminate the bonding action. In order to prevent this, another lance, the so-called air lance L, is introduced approximately 30 cm ahead of the sand lance $S_1$. Air is blown in through this air lance L, so that any dust which may have already been deposited is whirled up again. As soon as the first section of the hollow space 15 is filled, which is the case when the outlet openings 17 of the lance $S_1$ are covered, the two lances $S_1$ and L are advanced by approximately 30 cm and the same procedure is repeated. These steps are repeated so many times until either the entire hollow space 22 is filled or the filling has reached such a level that a bonding action between the individual elements and the tubular sheathing which is sufficient for force transmission has been reached.

In order to ensure that the hollow space 22 is completely filled even in the apex in the sheathing 5 which is in an inclined position and has a circular cross section, the sand lance $S_1$ is preferably moved back and forth several times in longitudinal direction while simultaneously blowing in sand, so that the sand is compacted well over the entire cross section. When large hollow spaces are to be filled, it is also possible to operate with several lances of different lengths in the above-described manner.

FIG. 6 shows the corresponding procedure in an upper anchoring unit 4", for example, on the tower 6" of a cable-stayed bridge. Before filling the hollow space 22 adjacent to the anchoring disc 11, the hollow space 22 must be sealed relative to the free area of the tubular sheathing by mounting a sealing member 16. This sealing member 16, which must be mounted together with the individual elements, must be mounted with particular care in order to prevent the thinly liquid resin used as the binder to penetrate through any untight areas. In the same manner as in the lower anchoring unit according to FIG. 5, the operation is also started from a low point, i.e., a sand lance $S_2$ is used which is approximately 30 cm from the sealing member 16 and which is followed by the distance $\Delta 1$ by the air lance L. By retracting the lances $S_2$ and L in accordance with the increasing filling height, the hollow space 22 is also completely filled in this case.

As shown in FIG. 7, after the hollow spaces 22 have been filled with sand, the binder is also pressed in from the low point, wherein the binder is composed particularly of a thinly liquid resin, predominantly epoxide resin. By using sand having essentially a single grain fraction, sufficient hollow spaces are available after blowing in the sand in spite of tight packing of the sand, so that the thinly liquid resin can be pressed in from the low point of the sand filling by means of an injecting lance $I_1$ until the resin emerges at the surface. Ventilation can also be carried out through the grain structure.

FIG. 7 additionally shows that it is also possible to press in two different materials, for example, initially resin and then cement paste. For this purpose, an additional lance $I_2$ is provided which initially is used as an overflow for the injection material introduced first and through which, when the first material has emerged and, thus, filling of the lower section is indicated, the second injection material for the upper portion 23 is pressed in. Filling of the upper section can be checked by means of an overflow opening 24. Consequently, the filling can be adapted to the actually required properties and costs can be saved as a result.

The invention is not limited by the embodiments described above which are presented as examples only but can be modified in various ways within the scope of protection defined by the appended patent claims.

We claim:

1. A method of introducing a casting compound composed of aggregates and a matrix with a hardening binder into a hollow space within a tubular sheathing of a tension member composed of one or more individual elements extending over an anchoring range of the tension member relative to a structural component, the method comprising first introducing into the hollow space a flow of compressed air and finely granular material through at least one tubular lance introduced in a longitudinal direction of the tension member through the anchoring range of the tension member, the finely granular material introduced into the hollow space forming a grain structure, and subsequently introducing the matrix in a liquid state into the grain structure.

2. The method according to claim 1, comprising deflecting the flow of compressed air and finely granular material at an outlet end of the lance from a conveying direction toward at least one side.

3. The method according to claim 2, comprising deflecting the flow by 90°.

4. The method according to claim 1, comprising using sand as the finely granular material.

5. The method according to claim 4, wherein the sand has essentially a single grain size.

6. The method according to claim 1, comprising introducing compressed air into the hollow space through an additional lance, wherein the additional lance is introduced ahead of and simultaneously with the lance for introducing the flow of compressed air and finely granular material.

7. The method according to claim 6, further comprising deflecting the compressed air at an end of the additional lance from a conveying direction toward at least one side.

8. The method according to claim 1, comprising introducing the flow of compressed air and finely granular material until a layer of finely granular material is formed in the hollow space, advancing the lance into the hollow space, and continuing to introduce compressed air and finely granular material until at least one additional layer of finely granular material is formed in the hollow space.

9. The method according to claim 1, wherein the hollow space has an apex, further comprising guiding the at least one lance in the apex of the hollow space.

10. The method according to claim 1, comprising using a synthetic resin as binder.

11. The method according to claim 10, wherein the synthetic resin is a two-component resin.

12. The method according to claim 11, wherein the two-component resin is epoxide resin.

13. An arrangement for introducing a casting compound composed of aggregates and a matrix with a hardening binder into a hollow space within a tubular sheathing of a tension member composed of one or more individual elements extending along an anchoring range of the tension member relative to a structural component, the arrangement comprising at least one tubular lance for introducing a flow of compressed air and finely granular material into the hollow space, the lance having an outlet end, the lance being closed at the outlet end and having at least one lateral outlet opening at the outlet end.

14. The arrangement according to claim 13, further comprising an additional tubular lance for introducing compressed air into the hollow space ahead of the lance for introducing the flow of compressed air and finely granular material, the additional lance having an outlet end, the outlet end of the additional lance being closed and having at least one lateral outlet opening.

15. The arrangement according to claim 13, wherein the at least one outlet opening has an oblong shape.

16. The arrangement according to claim 13, wherein the at least one lance has an internal cross section, further comprising an insert of elastic material at the outlet end of the lance, wherein the insert extends across the internal cross section of the lance.

17. The arrangement according to claim 16, wherein the elastic material is rubber.

* * * * *